United States Patent [19]

Buske

[11] Patent Number: 4,776,107

[45] Date of Patent: Oct. 11, 1988

[54] WEB TREATMENT SYSTEM

[75] Inventor: Walter E. Buske, Amesbury, Mass.

[73] Assignee: Wolverine Corporation, Methuen, Mass.

[21] Appl. No.: 115,161

[22] Filed: Oct. 30, 1987

[51] Int. Cl.[4] ..... F26B 13/00

[52] U.S. Cl. ..... 34/155; 34/231

[58] Field of Search ..... 34/155, 160, 231

[56] References Cited

U.S. PATENT DOCUMENTS

| | | | |
|---|---|---|---|
| 2,779,105 | 1/1957 | Park | 34/231 |
| 2,982,185 | 3/1960 | Drew | 34/43 |
| 3,181,250 | 5/1965 | Vits | 34/23 |
| 3,398,466 | 8/1968 | Brown | 34/160 |
| 3,525,164 | 8/1970 | Brown | 34/155 |
| 3,559,301 | 2/1971 | Fraser | 34/156 |
| 3,587,177 | 6/1971 | Overly | 34/156 |
| 3,793,491 | 6/1973 | Creapo | 34/156 |
| 3,873,013 | 3/1975 | Stibbe | 34/156 X |
| 3,964,656 | 6/1976 | Hella | 34/156 X |
| 4,216,592 | 8/1980 | Koch, II | 34/160 |
| 4,438,572 | 3/1984 | Kaminski | 34/155 X |
| 4,472,888 | 9/1984 | Spiller | 34/160 X |

*Primary Examiner*—Steven E. Warner

[57] ABSTRACT

A web treatment system includes main housing structure, chamber structure in the main housing structure that defines a thermally insulated web treatment zone, and structure that defines a web inlet at one end of the web treatment zone and a web outlet at the opposite end of the web treatment zone, so that a web path through the web treatment zone between the web inlet and the web outlet is defined. A series of elongated gas distributing nozzle bar structures are supported in the upper region of the web treatment zone above and along the length of the web path. Each gas distribution nozzle bar structure has opposed end walls and elongated lower wall structure extending between the end walls across the width of the web treatment zone, an inlet port in one end wall and outlet port structure in the lower wall extending along the length of the gas distribution nozzle bar for directing flow of gas from the supply plenum downwardly toward the web path. In each nozzle bar structure adjacent its inlet port is eddy creating structure and remote from the inlet port is flow stabilization structure such that the velocities of gas flows exiting from each nozzle bar structure are substantially uniform over the length of the nozzle bar structure and the width of the web treatment zone.

17 Claims, 2 Drawing Sheets

FIG. 1
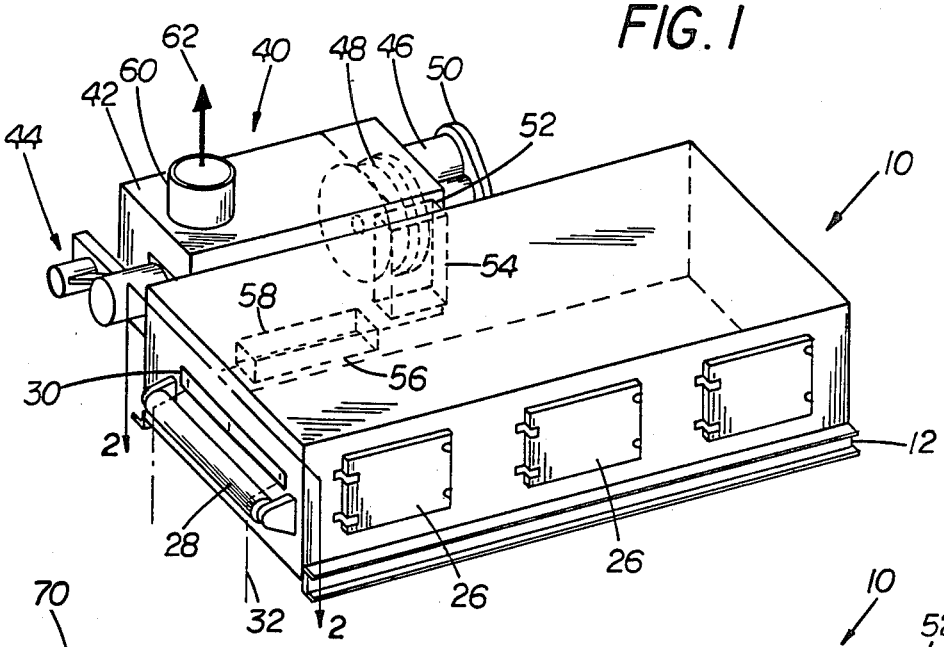
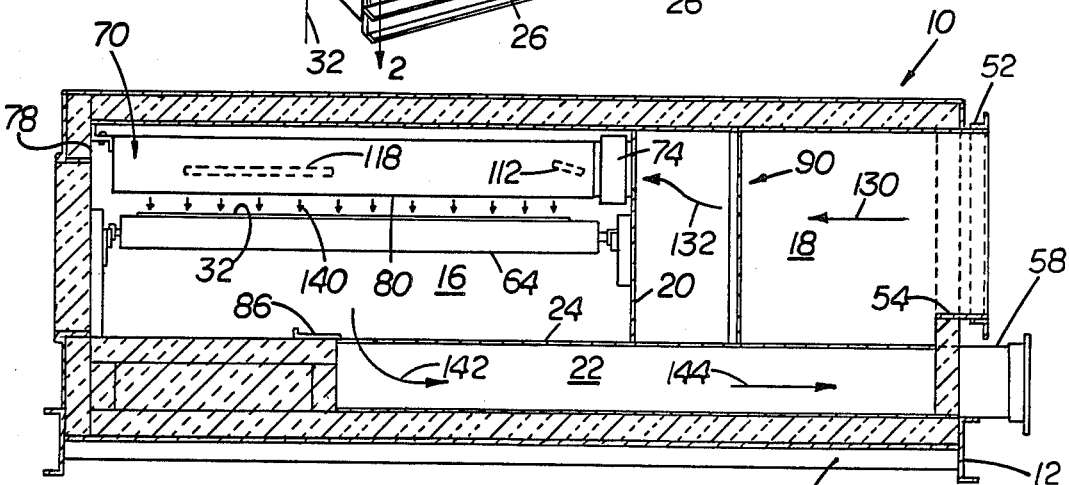
FIG. 4
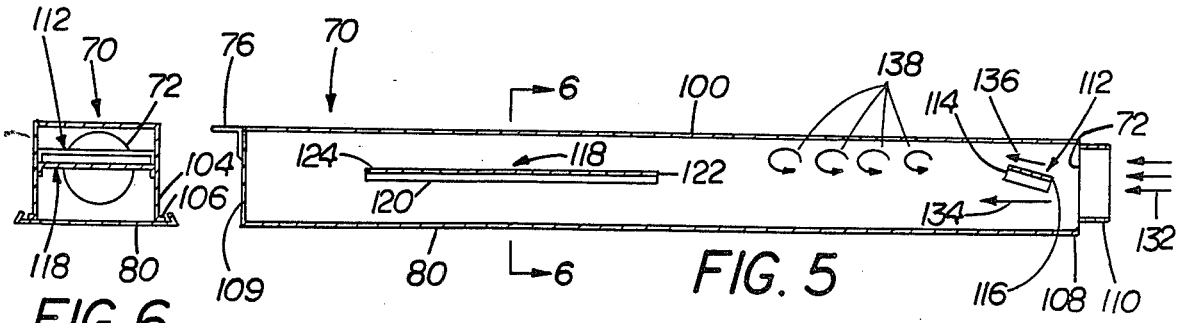
FIG. 6
FIG. 5
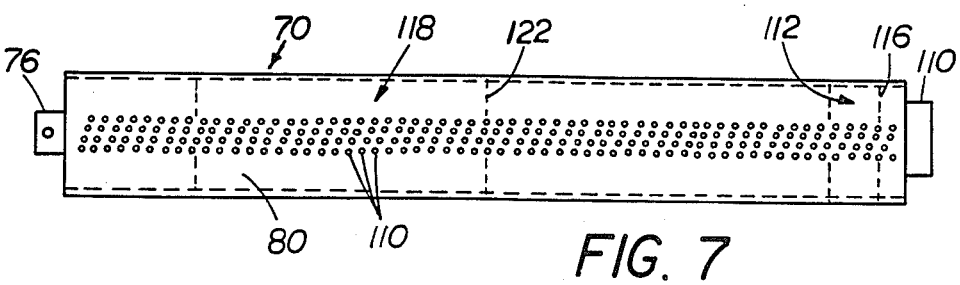
FIG. 7

WEB TREATMENT SYSTEM

This invention relates to material treatment, and more particularly to systems of the type particularly useful for treatment of web materials such as paper, plastics material, textiles metal and the like by interaction with a treatment gas to dry, clean, stabilize or otherwise treat the web to provide a desired end product.

In accordance with one apsect of the invention, there is provided a web treatment system that includes main housing structure, chamber structure in the main housing structure that defines a thermally insulated web treatment zone, and structure that defines a web inlet at one end of the web treatment zone and a web outlet at the opposite end of the web treatment zone, so that a web path through the web treatment zone between the web inlet and the web outlet is defined. A series of elongated gas distributing nozzle bar structures are supported in the upper region of the web treatment zone above and along the length of the web path. At one side of the web treatment zone is structure that defines a gas supply plenum and includes sidewall structure between the gas supply plenum and the web treatment zone in which are a series of transfer ports that provide communication between the gas supply plenum and corresponding ones of the series of gas distribution nozzle bar structures. Each gas distribution nozzle bar structure has opposed end walls and elongated lower wall structure extending between the end walls across the width of the web treatment zone, an inlet port in one end wall in communication with a transfer port of the supply plenum and outlet port structure in the lower wall extending along the length of the gas distribution nozzle bar for directing flow of gas from the supply plenum downwardly toward the web path. Discharge port structure provides communication between the web treatment zone and a gas discharge plenum for exhausting gas from the chamber structure. In each nozzle bar structure adjacent its inlet port is eddy creating structure and remote from the inlet port is flow stabilization structure such that the velocities of gas flows exiting from each nozzle bar structure are substantially uniform over the length of the nozzle bar structure and the width of the web treatment zone.

In preferred embodiments, at least ten nozzle bar units are spaced along the length of the web treatment zone; each nozzle bar unit has a length at least four times its height dimension and is of generally uniform cross sectional configuration along its axial length; the eddy creating structure in each nozzle bar structure is an impervious sheet member whose leading edge is closer to the outlet port structure than its trailing edge (and preferably inclined at an angle of at least about five degrees), and its length is less than about ten percent of the axial length of the nozzle bar structure; and the stabilization structure has a leading edge spaced from the inlet port at least about half way along the axial length of the nozzle bar, a length at least about twenty percent of the axial length of the nozzle bar structure, and extends generally parallel to the axis of the nozzle bar structure.

In a particular embodiment, the outlet port structure of each nozzle bar structure is defined by a multiplicity of discharge apertures uniformly spaced along the length of the nozzle bar; and each nozzle bar structure is of rectangular cross sectionalal configuration and includes a planar bottom wall sheet member that extends across the width of the treatment zone and in which the outlet port structure is defined. A gas supply unit is coupled to the supply and discharge plenums, the gas supply unit including burner means for heating gas to a temperature of at least about 250° F., and circulating means for circulating gas through the web treatment system at a rate of at least about 5,000 CFM.

Other features and advantages of the invention will be seen as the following description of a particular embodiment progresses, in conjuction with the drawings, in which:

FIG. 1 is a perspective view of a web treatment system in accordance with the invention;

FIG. 4 is a sectional view taken along the line 4—4 of FIG. 2;

FIG. 5 is an enlarged diagrammatic sectional view showing details of a nozzle bar assembly employed in the web treatment system shown in FIG. 1;

FIG. 6 is a sectional view taken along the line 6—6 of FIG. 5; and

FIG. 7 is a bottom view of the nozzle bar unit of FIG. 5.

Description of Particular Embodiment

Figure 2:
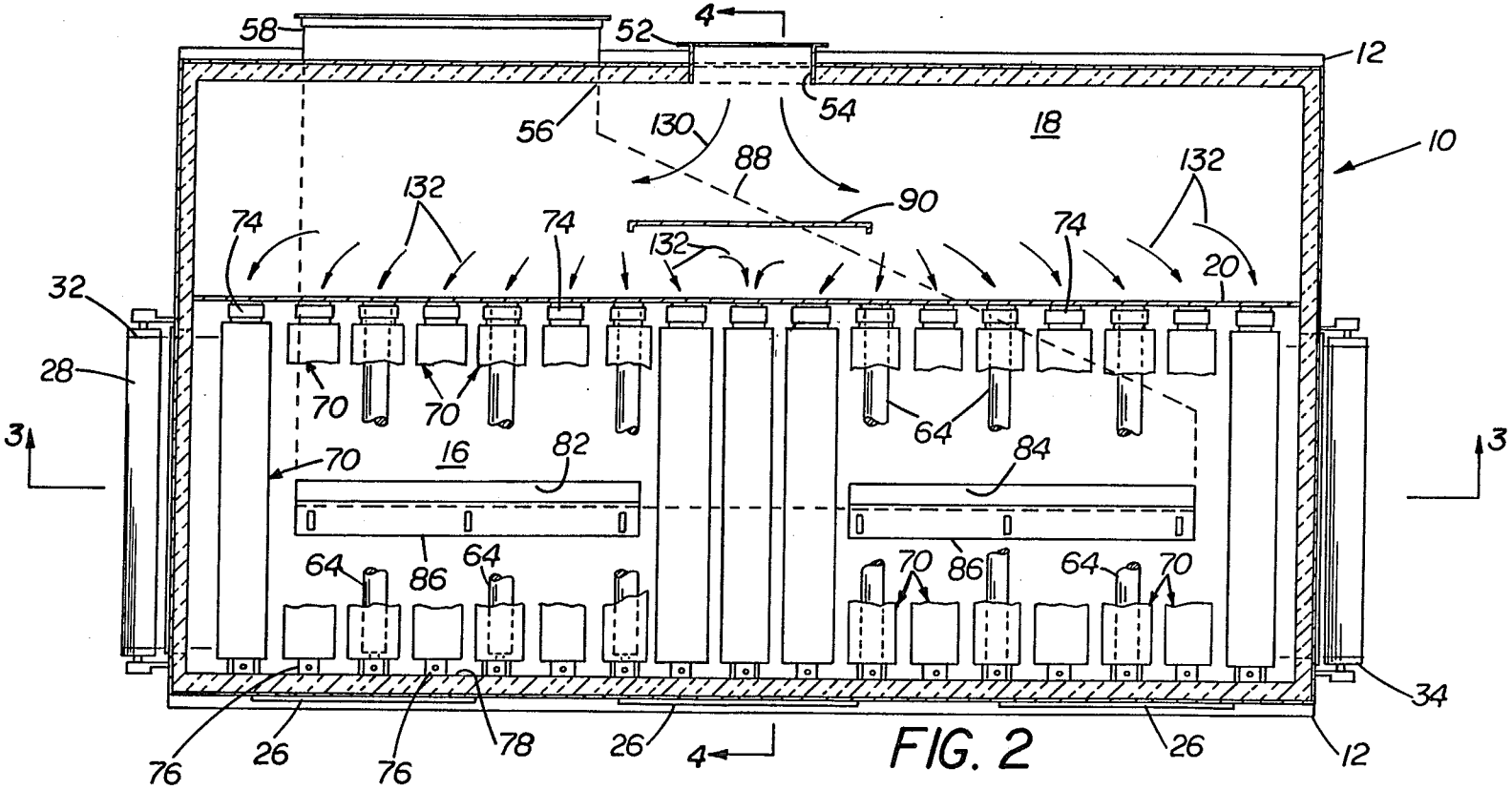
FIG. 2 is a sectional view taken along the line 2—2 of FIG. 1.

The web treatment system as shown in FIG. 1 includes thermally insulated main housing 10 that has a width of about nine feet, a length of about seventeen feet and a depth of about three and one half feet. Housing 10 is supported on longitudinal frame members 12 and transverse frame members 14, and may be mounted in a low headroom region, for example over web handling machinery. Defined within housing 10 is a web treatment chamber 16 that is about five feet in width and sixteen feet in length, a supply plenum region 18 to the rear of treatment 16 and spaced from chamber 16 by sidewall 20; and return plenum region 22 below treatment chamber 16 and spaced from that chamber by horizontal bottom wall 24 Access doors 26 on the front of housing 10 provide access to treatment chamber 16. Idler roller mechanism 28 adjacent web entrance port 30 supports web 32 for entry into treatment chamber 16, and a similar idler roll mechanism 34 (FIGS. 2 and 3) is adjacent exit opening 36 at the opposite end of housing 10.

Disposed to the rear of housing 10 is air supply unit 40 that includes insulated housing 42 on which is mounted Maxon burner unit 44 and 15-horsepower motor 46 that is coupled to 12,000 CFM rated circulating fan 48 by drive coupling 50. Supply air at a temperature of up to approximately 300° F. is furnished by unit 40 through coupling 52 and port 54 at the rear of housing 10 to supply plenum 18. Return air from treatment chamber 16 is exhausted from return plenum 22 (FIG. 4) through port 56 and coupling 58 for return to supply unit 40, excess air being exhausted through conduit 60 upwardly as diagrammatically indicated by arrow 62.

Figure 3:
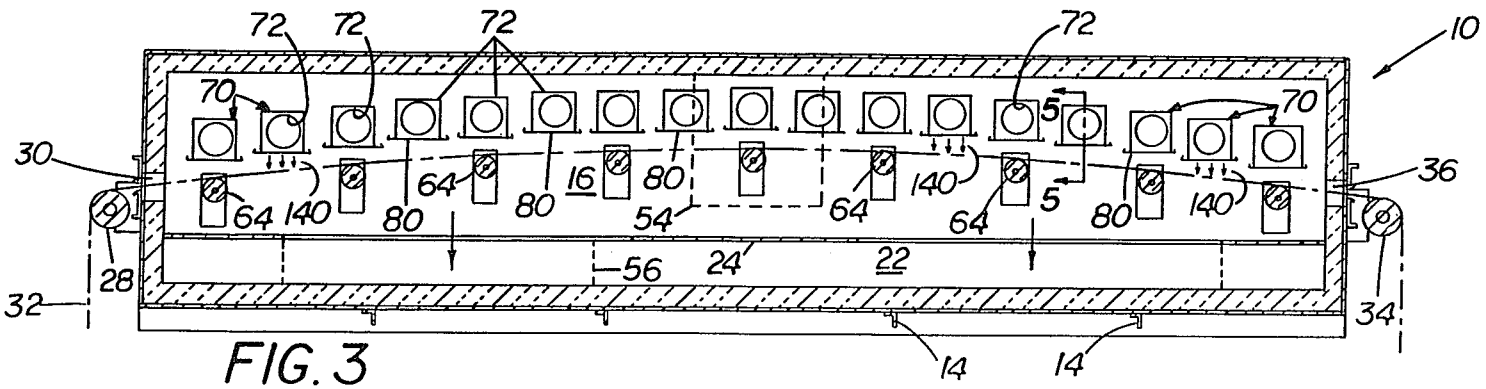
FIG. 3 is a sectional view taken along the line 3—3 of FIG. 2.

Further aspects of the web treatment system may be seen with reference to FIGS. 2–4. Disposed within treatment chamber 16 are a series of nine 4-inch diameter aluminum rollers 64 along an arched line (as indicated in FIG. 3) above which are disposed a series of seventeen low profile nozzle bar units 70, each of which has an end port 72 connected to supply plenum 18 by coupling 74, a support flange 76 at its opposite end connected to vertical wall 78, and a nozzle plate 80 at its lower surface in which is formed an array of discharge apertures 110 (FIG. 7) that extend across the width of the web treatment zone.

Formed in base wall 24 of treatment chamber 16 are discharge apertures 82, 84, each of which has an adjustable valve plate member 86 which is movable to vary the area of its discharge opening 82, 84. Openings 82, 84 communicate with return plenum 22 that has inclined sidewall 88 and directs the flow of return air to outlet port 56. A deflection baffle plate 90 is fixed in supply plenum 18 in juxtaposition to inlet port 54.

Further details of the nozzle bar units 70 may be seen with reference to FIGS. 5–7. Each nozzle bar unit is constructed of 14-gauge aluminized steel and has a length of about five feet, a planar top wall 100, planar sidewalls 102, 104 that are about nine inches long and spaced about seven inches apart and have flanges 106 at their lower edges to which planar nozzle plate 80 is attached, and planar end walls 108, 109. Four rows of one guarter inch diameter discharge apertures 110 (over fifty apertures in each row) are formed in nozzle plate 80. Six inch diameter port 72 is formed in end wall 108 to which sleeve 110 is attached. Disposed within each nozzle bar unit 70 adjacent inlet opening 72 is planar eddy enhancing baffle sheet 112 that has flanges 114 welded to opposed sidewalls 102, 104. Eddy enhancing sheet 112 has a length of three inches with its inlet edge 116 centrally located on the axis of inlet port 72 and is inclined upwardly at an angle of 15° to that axis. Stabilization sheet 118 has flanges 120 that are similarly welded to opposed sidewalls 102, 104 and has a leading edge 122 disposed about thirty inches from port 72 (end wall 108) and is horizontally located on the axis of port 72. Stabilization sheet has a length of about twenty-one inches and its trailing edge 124 is spaced about nine inches from end wall 109.

In system operation, hot air at a temperature of up to approximately 300° F. is flowed at a rate of approximately 12,000 CFM by blower 48 through port 54 into supply plenum 18 as indicated by arrows 130 where it is deflected by baffle 90 for flow as indicated by arrows 132 through couplings 74 and ports 72 into the nozzle bar units 70. A portion of the inlet airflow passes underneath deflection sheet 112 as indicated by arrow 134 and a second portion is deflected upwardly as indicated by arrow 136 and creates an eddy region as indicated by arrows 138 in the upper portions of nozzle bars 70. As the airflow continues along the nozzle bar, the eddy flow conditions tend to be reduced by stabilization sheet 118. Along the entire length of each nozzle bar 70, hot air is discharged downwardly through the ports 110 in nozzle plate 80 for impingement on the web 32 as indicated by arrows 140. The airflow after web treatment is exhausted from treatment chamber 16 through discharge ports 82, 84 as indicated by arrows 142, 144 for flow through port 56 and coupling conduit and returned to supply unit 40. Measurements of airflow along the length of the nozzle bar indicate that the eddy enhancing and stabilization sheet structures enhance the uniformity of airflows from the nozzle ports 110 over the entire five foot length of the nozzle bar units 70 such that substantially uniform airflows 140 impinge on the web 32 to be treated over the entire width of the web.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. Web treatment apparatus comprising main housing structure, chamber structure in said main housing structure that defines a thermally insulated web treatment zone, structure defining a web inlet at one end of said web treatment zone and a web outlet at the opposite end of said web treatment zone, structure defining a web path through said web treatment zone between said web inlet and said web outlet, a series of elongated gas distributing nozzle bar structures supported in the upper region of said web treatment zone above said web path and along the length of said web path, structure in said housing structure defining a gas supply plenum at one side of said web treatment zone chamber structure including intermediate wall structure between said gas supply plenum and said web treatment zone, said intermediate wall structure defining a sidewall of said web treatment zone chamber structure, a series of ports in said intermediate wall structure that provide communication between said gas supply plenum and corresponding ones of said series of gas distribution nozzle bar structures, each said gas distribution nozzle bar structure having opposed end wall structures and elongated lower wall structure extending between said end wall structures across the width of said web treatment zone, an inlet port in communication with an outlet port of said supply plenum in one end wall structure and outlet port structure in said lower wall structure extending along the length of the gas distribution nozzle bar for directing flow of gas from said supply plenum downwardly toward said web path, eddy creating structure in each said nozzle bar structure adjacent its said inlet port, and flow stabilization structure in each said nozzle bar structure remote from its inlet port, said eddy creating structure extending over. a length less than about ten percent the axial length of said elongated nozzle bar structure and said stabilization structure having a length that is at least about twenty percent of the axial length of said nozzle bar such that the velocities of gas flows exiting from each said nozzle bar structure are substantially uniform over the length of the nozzle bar structure and the width of said web treatment zone; and structure defining a gas discharge plenum adjacent said web treatment zone chamber structure including wall structure between said gas discharge plenum and said web treatment chamber, and discharge port structure in said wall structure that provides communication between said web treatment zone and said gas discharge plenum for exhausting gas from said chamber structure.

2. The web treatment system of claim 1 wherein said eddy creating structure and said flow stabilization structure are impervious sheet members.

3. The web treatment system of claim 1 wherein said eddy creating structure is an impervious sheet member and its leading edge is closer to said outlet port structure than its trailing edge.

4. The web treatment system of claim 1 wherein said eddy creating structure is a planar member that is inclined at an angle of at least about five degrees to the axis of said nozzle bar structure and extends across the width of said nozzle bar structure.

5. The web treatment system of claim 1 wherein said eddy creating structure has a leading edge immediately adjacent said inlet port and has a length that is less than about ten percent of the axial length of said nozzle bar structure; and said stabilization structure has a leading edge spaced from said inlet port at least about half way along the axial length of the nozzle bar, and has a length that is at least about twenty percent of the axial length of said nozzle bar structure.

6. The web treatment system of claim 1 wherein each said gas distribution nozzle bar has a length at least four times its height dimension and is of generally uniform cross sectional configuration along its axial length.

7. The web treatment system of claim 1 wherein said flow stabilization structure is an impervious member disposed generally parallel to the axis of said nozzle.

8. The web treatment system of claim 1 wherein said outlet port structure of each said nozzle bar structure is defined by a multiplicity of discharge apertures uniformly spaced along the length of said nozzle bar structure.

9. The web treatment system of claim 1 wherein each said nozzle bar structure is of rectangular configuration and includes a planar bottom wall sheet member that extends across the width of said treatment zone and in which said outlet port structure is defined.

10. The web treatment system of claim 9 wherein said eddy creating structure is an impervious sheet member and its leading edge is closer to said outlet port structure than its trailing edge, said flow stabilization structure is an impervious sheet member disposed generally parallel to the axis of said nozzle.

11. The web treatment system of claim 10 wherein said eddy creating structure has a leading edge immediately adjacent said inlet port and a length that is less than about ten percent of the axial length of said nozzle bar structure and is inclined at an angle of at least about five degrees to the axis of said nozzle bar structure and extends across the width of said nozzle bar structure; and said stabilization structure has a leading edge spaced from said inlet port at least about half way along the axial length of the nozzle bar, and has a length that is at least about twenty percent of the axial length of said nozzle bar structure.

12. The web treatment system of claim 1 and further including a gas supply unit coupled to said supply and discharge plenums, said gas supply unit including burner means for heating gas to a temperature of at least about 250° F., and circulating means for circulating gas through the web treatment system at a rate of at least about 5,000 CFM.

13. The web treatment system of claim 12 wherein there are at least ten nozzle bar units spaced along the length of said web treatment zone.

14. The web treatment system of claim 13 wherein each said nozzle bar structure is of rectangular configuration and includes a planar bottom wall sheet member that extends across the width of said treatment zone and in which said outlet port structure is defined.

15. The web treatment system of claim 14 wherein said eddy creating structure has a leading edge immediately adjacent said inlet port and has a length that is less than about ten percent of the axial length of said nozzle bar structure and said stabilization structure has a leading edge spaced from said inlet port at least about half way along the axial length of the nozzle bar, and has a length that is at least about twenty percent of the axial length of said nozzle bar structure.

16. The web treatment system of claim 15 wherein said eddy creating structure is an impervious planar sheet member that is inclined at an angle of at least about five degrees to the axis of said nozzle bar structure and extends across the width of said nozzle bar structure; and said flow stabilization structure is an impervious planar sheet member disposed generally parallel to the axis of said nozzle bar structure and extends across the width of said nozzle bar structure.

17. The web treatment system of claim 16 wherein said outlet port structure of each said nozzle bar structure is defined by a multiplicity of discharge apertures uniformly spaced along the length of said nozzle bar structure.

* * * * *